US006530844B2

(12) United States Patent
Lin

(10) Patent No.: US 6,530,844 B2
(45) Date of Patent: Mar. 11, 2003

(54) BALL BARRIER ASSEMBLY

(76) Inventor: Heng-Che Lin, 1F, No. 16, Lane 643, Wen-Lin Rd., Taipei City (TW)

( * ) Notice: Subject to any disclaimer, the term of this patent is extended or adjusted under 35 U.S.C. 154(b) by 0 days.

(21) Appl. No.: 09/927,728

(22) Filed: Aug. 10, 2001

(65) Prior Publication Data

US 2003/0032493 A1 Feb. 13, 2003

(51) Int. Cl.[7] ..... A63B 69/36; A63B 63/00
(52) U.S. Cl. ..... 473/197; 273/400; 473/478
(58) Field of Search ..... 473/197, 168–170, 473/172, 195, 196, 478; 273/398–402

(56) References Cited

U.S. PATENT DOCUMENTS 1,629,907 A * 5/1927 Dwyer ..... 473/190
2,805,070 A * 9/1957 Waters ..... 273/394
3,197,208 A * 7/1965 Makar ..... 473/190
3,741,549 A * 6/1973 Wilson ..... 473/196
5,088,740 A * 2/1992 Peterson ..... 135/127
5,269,527 A * 12/1993 Noval ..... 473/197
5,823,885 A * 10/1998 Stempfer ..... 273/400
5,876,291 A * 3/1999 Dubose ..... 473/197
5,941,529 A * 8/1999 Kinsey ..... 273/401
6,319,145 B1 * 11/2001 Coughlan ..... 273/407

* cited by examiner

*Primary Examiner*—Mark S. Graham
(74) *Attorney, Agent, or Firm*—Marger Johnson & McCollom, P.C.

(57) ABSTRACT

A ball barrier assembly includes a looped barrier frame, an upright rear leg rod, a support rod unit, and a barrier fabric net. The looped barrier frame has a lower base portion and an upper frame portion. The upright rear leg rod has an upper end connected to the upper frame portion of the barrier frame, and a lower end that cooperates with the lower base portion to the assembly on a ground surface. The support rod unit interconnects the rear leg rod and the barrier frame. The barrier fabric net has a peripheral portion connected to the barrier frame, and collects a ball that passes through the barrier frame and that impinges upon the net.

2 Claims, 7 Drawing Sheets

BALL BARRIER ASSEMBLY

BACKGROUND OF THE INVENTION

1. Field of the Invention

The invention relates to a ball barrier assembly use in sports training and for practicing, more particularly to a ball barrier assembly that can stand stably on a ground surface.

2. Description of the Related Art

Referring to FIG. 1, a first conventional ball barrier assembly 1 is shown to comprise a looped barrier frame 11, a support frame 12, and a barrier fabric net 13. The barrier frame 11 and the support frame 12 are made from flexible materials, such as plastics and memory alloys. The barrier frame 11 has a periphery that forms a ball projectile opening 14. The support frame 12 is connected to the barrier frame 11, and is adapted to be disposed on a ground surface. The net 13 is connected to the barrier frame 11, and is adapted to collect a ball that passes through the opening 14 of the barrier frame 11 and that impinges upon the net 13.

For storage, the barrier frame 11 can be twisted at the same time, as shown in FIG. 2, to form a small disc with a size equal to one-third of the area of the opening 14, as illustrated in FIG. 3.

FIG. 4 illustrates a second conventional ball barrier assembly 3 disclosed in U.S. Pat. No. 5,269,527. The ball barrier assembly 3 includes two leg frames 31, a curved barrier frame 32, and a barrier fabric net 33. The leg frames 31 are adapted to be disposed on a ground surface. The barrier frame 32 has opposite ends 321 connected respectively to upper ends 311 of the leg frames 31, and cooperates with the leg frames 31 to form a ball projectile opening 34. The net 33 is loosely draped on the barrier frame 32, and is adapted to impinge a ball that passes through the opening 34, such that the ball falls on the surrounding area of the leg frames 31.

The construction of the aforementioned conventional ball barrier assemblies 1, 3 attains the purpose of impinging a ball via a net. However, during actual usage, the support frame 12 and the leg frames 31 of the conventional ball barrier assemblies 1, 3 cannot stably support the barrier frames 11, 32 on the ground surface due to lack of support.

Referring to FIG. 5, a third conventional ball barrier assembly 2 is shown to be substantially similar to the ball barrier assembly 1 of FIG. 1. The ball barrier assembly 2 includes a looped barrier frame 21, a lower support frame 22, a rear leg rod 25, and a barrier fabric net 23. The barrier frame 21 and the support frame 22 are made from flexible materials, such as plastics and memory alloys. The barrier frame 21 has a periphery that forms a ball projectile opening 24. The support frame 22 is adapted to be disposed on a ground surface. The rear leg rod 25 is connected to the barrier frame 21 and the support frame 22. The net 23 is connected to the barrier frame 21, and is adapted to collect a ball that passes through the opening 24 of the barrier frame 21 and that impinges upon the net 23.

While the second ball barrier assembly 2 has a rear leg rod 25 for supporting the barrier frame 21, however, the rear leg rod 25 cooperates with the support frame 22 to form only two supporting points for the barrier frame 21, which is still not enough to stably support the barrier frame 21 on the ground surface.

SUMMARY OF THE INVENTION

Therefore, the main object of the present invention is to provide a ball barrier assembly capable of overcoming the aforementioned drawbacks of the prior art.

Accordingly, a ball barrier assembly of this invention comprises a looped barrier frame, an upright rear leg rod, a support rod unit, and a barrier fabric net. The looped barrier frame has a lower base portion and an upper frame portion. The lower base portion is adapted to be disposed on a ground surface, and is formed with at least two linear segments. The upper frame portion has a curved intermediate segment and two end segments. The two end segments extend downwardly from the curved intermediate segment, and are connected to the lower base portion. The upright rear leg rod has an upper end and a lower end. The upper end is connected to the curved intermediate segment of the upper frame portion of the barrier frame. The lower end is adapted to be disposed on the ground surface so as to cooperate with the linear segments of the lower base portion of the barrier frame to form at least three supporting points that are to be disposed in a triangular formation on the ground surface. The support rod unit interconnects the lower end of the rear leg rod and the lower base portion of the barrier frame. The barrier fabric net has a peripheral portion connected to the barrier frame, and is loosely draped on the barrier frame so as to form a lower section that extends to the ground surface, and that is adapted to collect a ball that passes through the barrier frame and that impinges upon the net.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
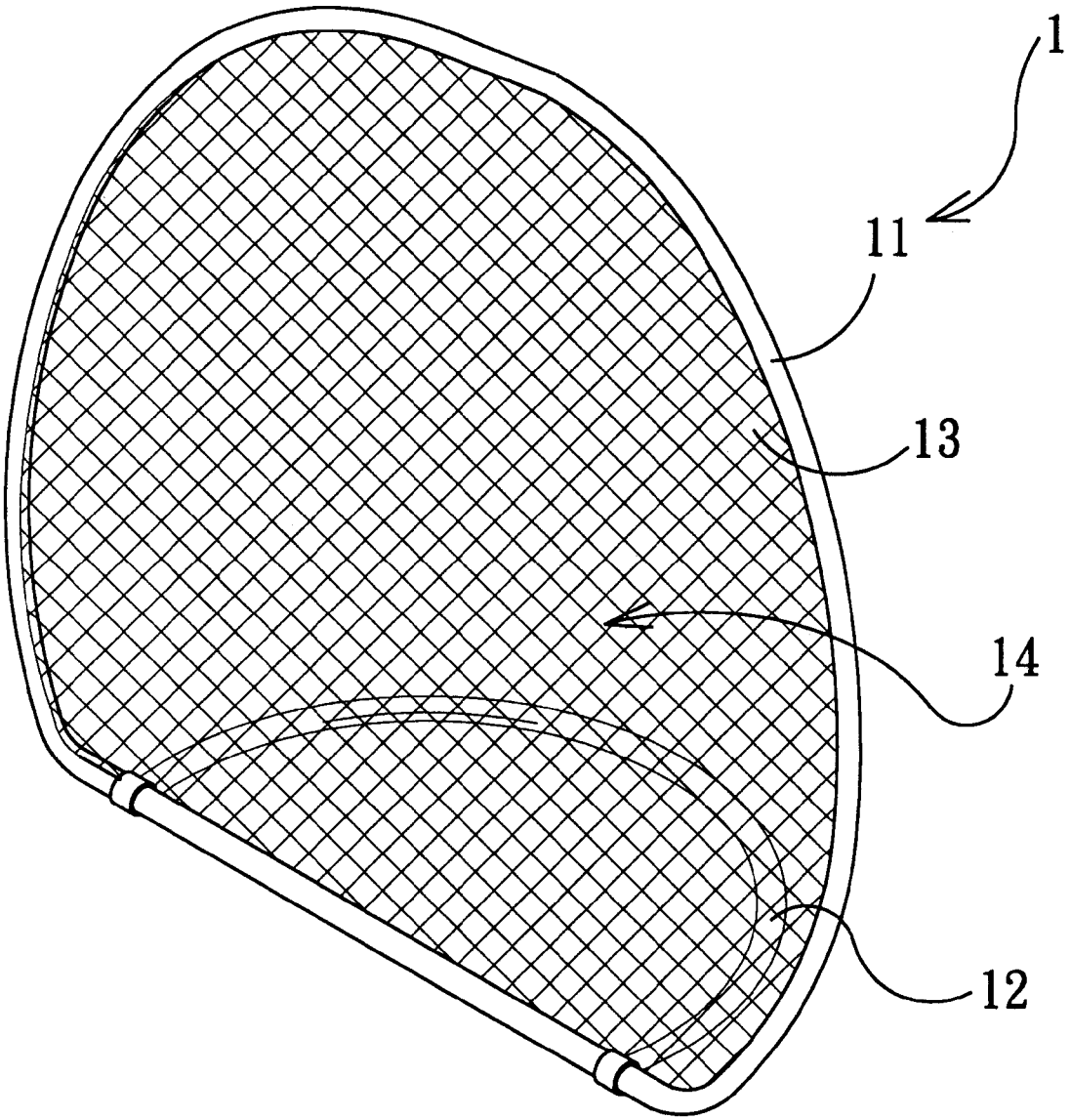
F I G. 1 PRIOR ART
FIG. 1 is a perspective view of a first conventional ball barrier assembly.
Figure 2:
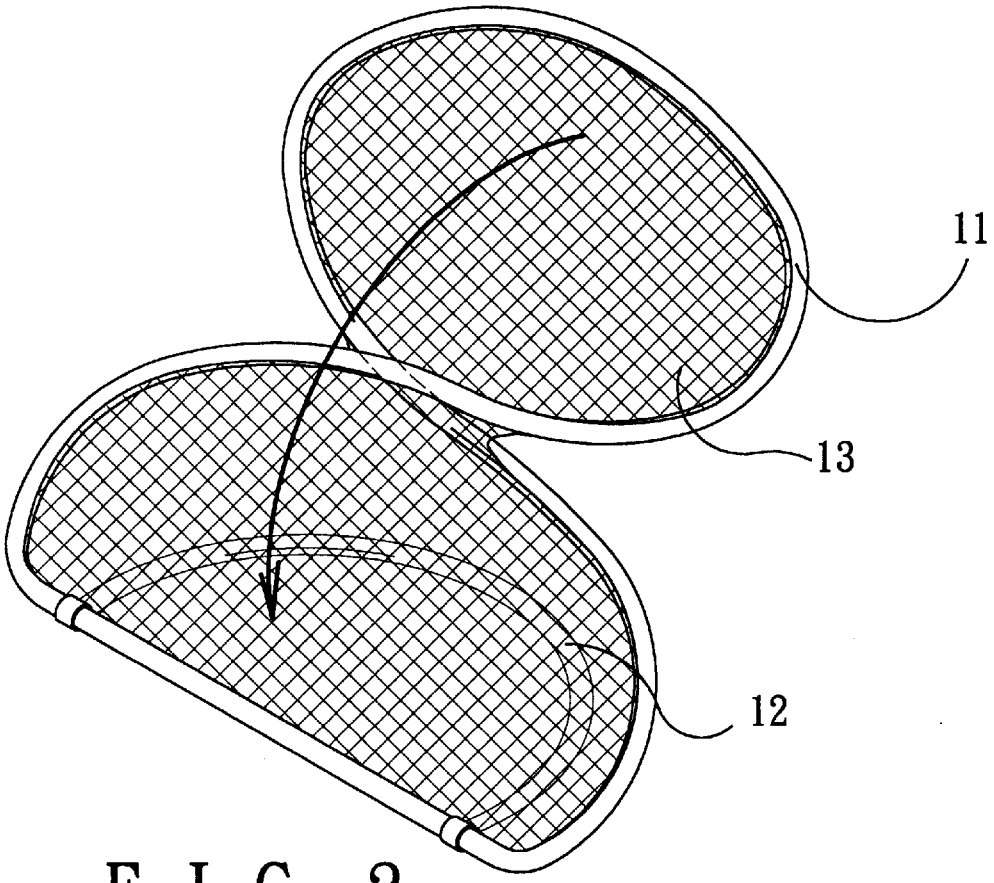
F I G. 2 PRIOR ART
FIG. 2 is a perspective view illustrating how the ball barrier assembly of FIG. 1 is stored.
Figure 3:
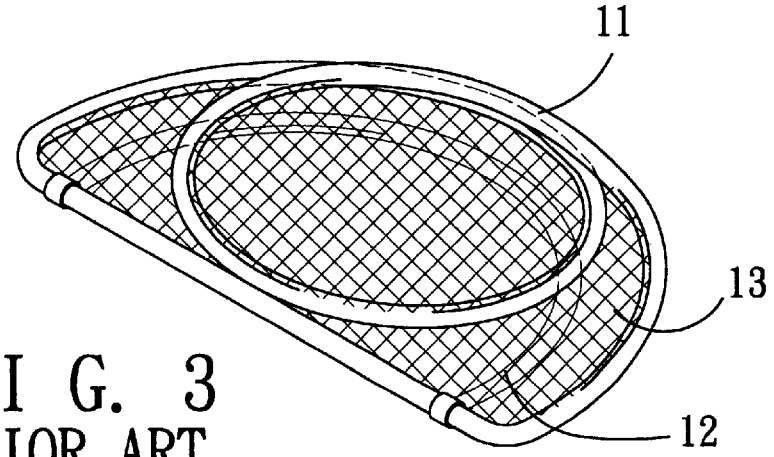
F I G. 3 PRIOR ART
FIG. 3 is a perspective view illustrating the ball barrier assembly of FIG. 1 in a folded state.
Figure 4:
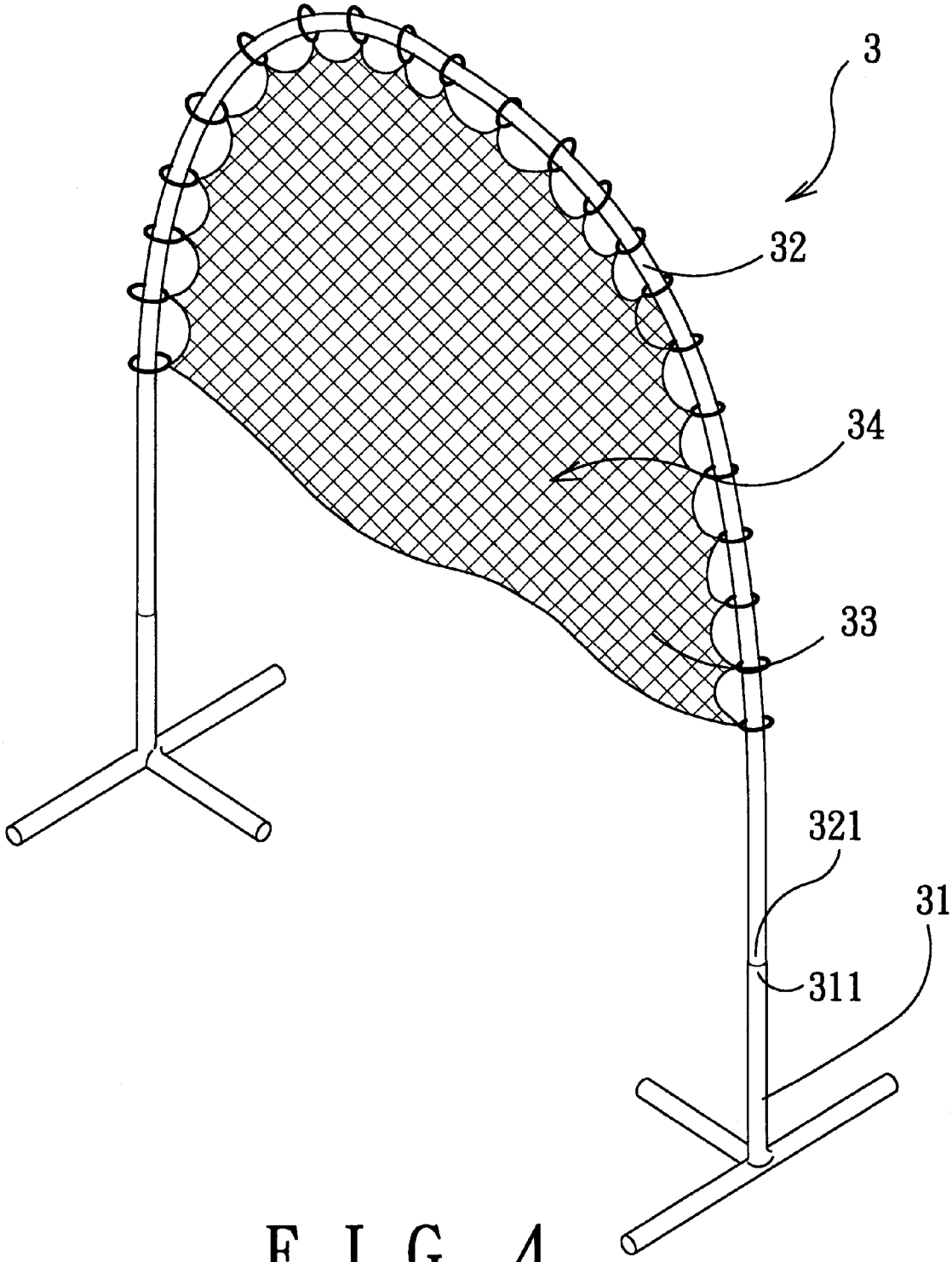
F I G. 4 PRIOR ART
FIG. 4 is a perspective view of a second conventional ball barrier assembly.
Figure 5:
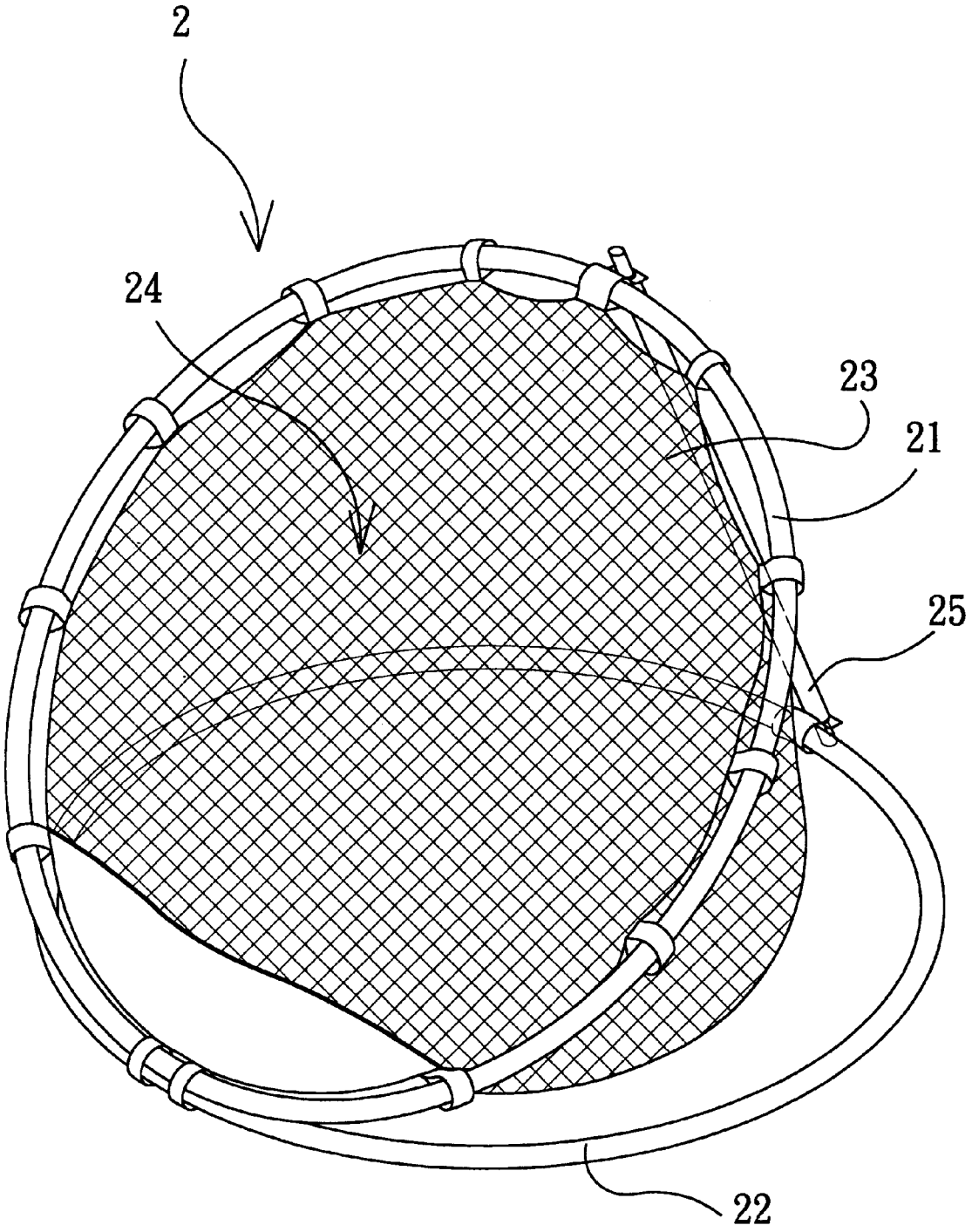
F I G. 5 PRIOR ART
FIG. 5 is a perspective view of a third conventional ball barrier assembly.

Before the present invention is described in greater detail, it should be noted that like elements are denoted by the same reference numerals throughout the disclosure.

Figure 6:
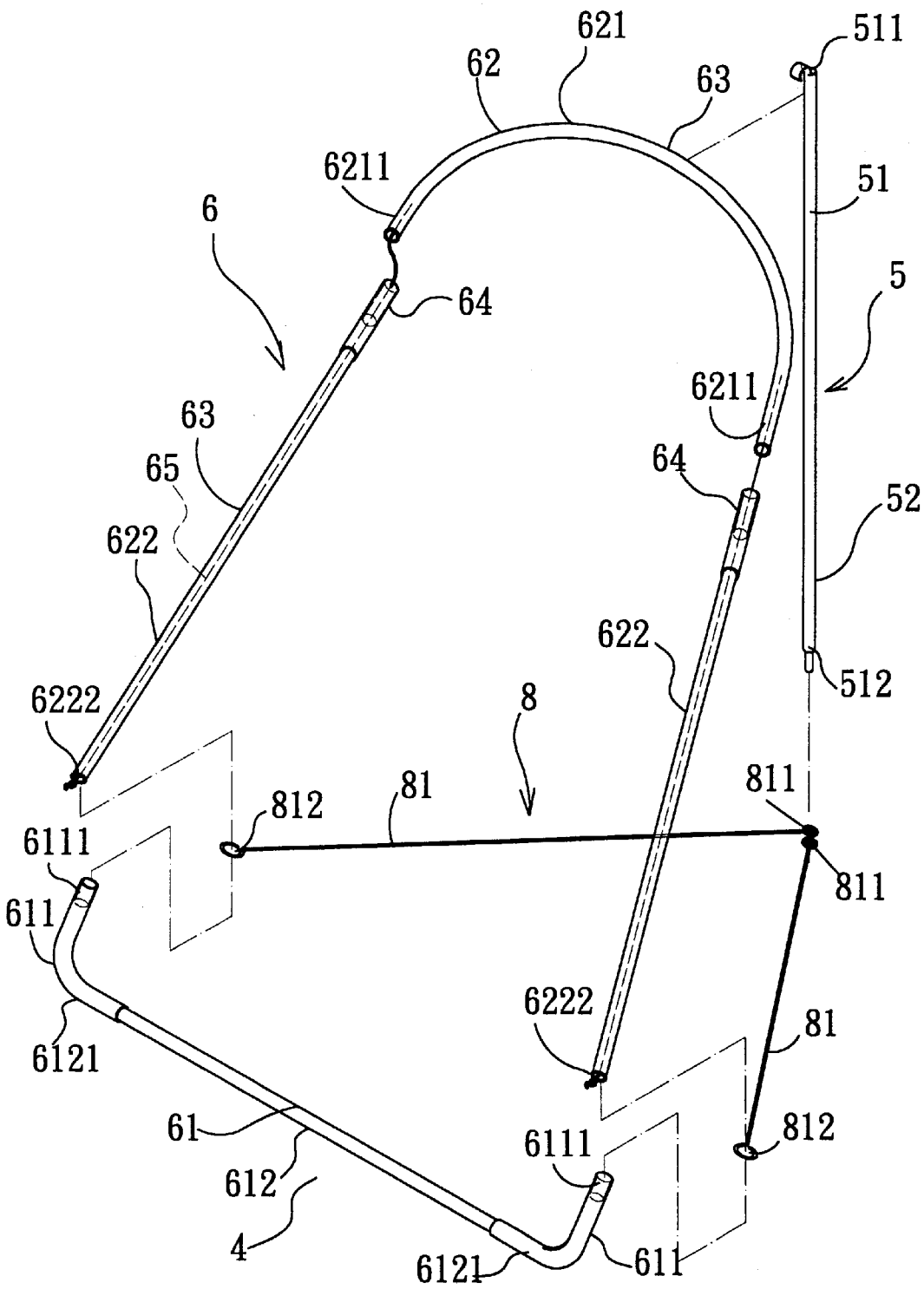
FIG. 6 is an exploded perspective view of the first preferred embodiment of a ball barrier assembly according to the present invention.
Figure 7:
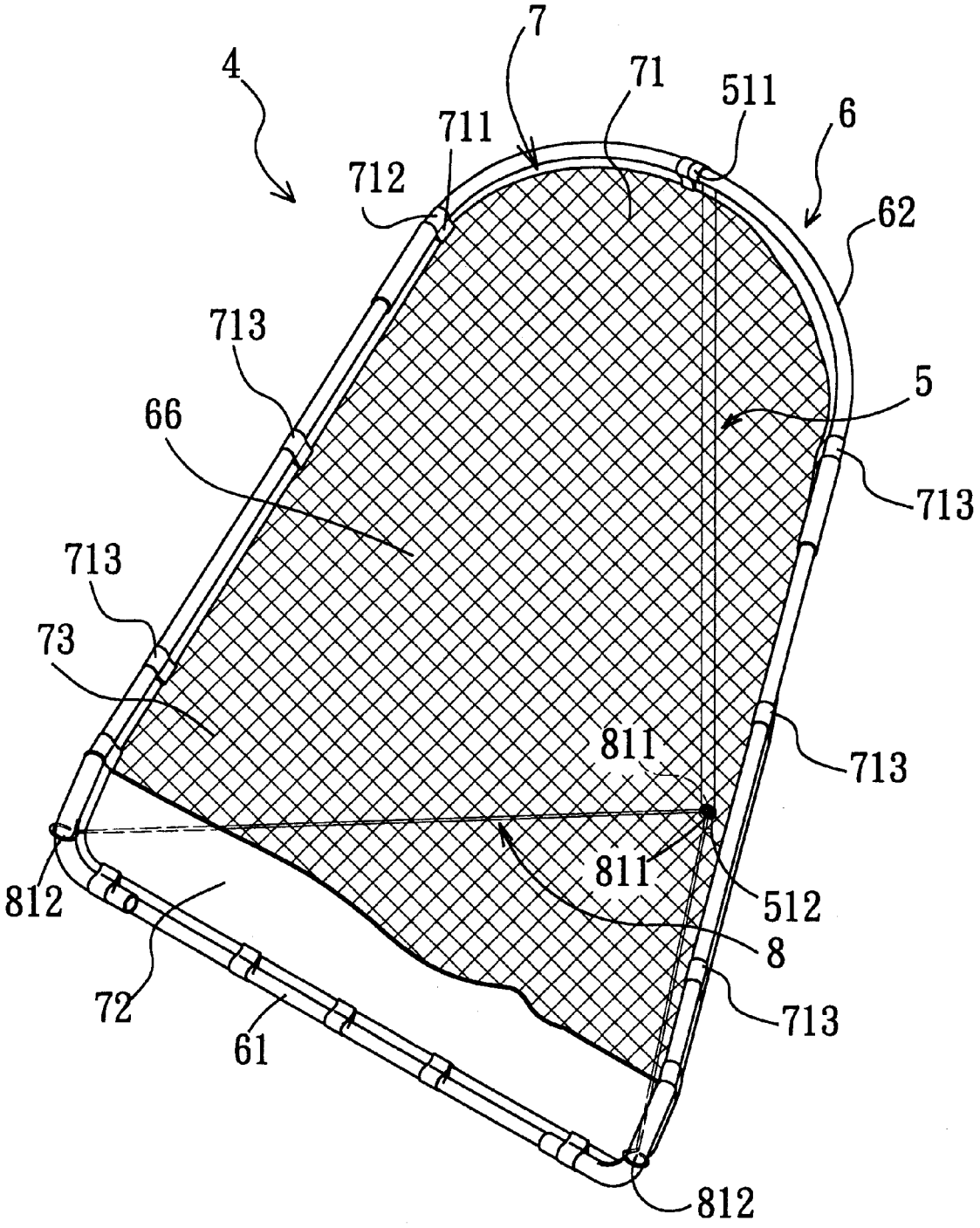
FIG. 7 is an assembled perspective view of the ball barrier assembly of FIG. 6.

Referring to FIGS. 6 and 7, the first preferred embodiment of a ball barrier assembly 4 according to the present invention is shown to comprise a looped barrier frame 6, an upright rear leg rod 5, a support rod unit 8, and a barrier fabric net 7. The looped barrier frame 6 has a lower base portion 61 and an upper frame portion 62. The lower base portion 61 is adapted to be disposed on a ground surface, and includes a horizontal rod 612 and a pair of elbow connectors 611 that are respectively sleeved on opposite ends 6121 of the horizontal rod 612. The elbow connectors 611 have tubular coupling ends 6111 that extend upwardly to connect with the upper frame portion 62. The upper frame portion 62 is formed from a plurality of removably interconnected hollow flexible pole segments 63, and has a curved intermediate segment 621 and two end segments 622. A flexible cord 65 passes through one of the two end segments 622, through the curved intermediate segment 621, and out of the other one of the two end segments 622, such that the pole segments 621, 622 are strung together to form a flexible pole body. The barrier frame 6 is thus easy to store when disassembled. The curved intermediate segment 621 has opposite ends 6211 connected to a respective one of the two end segments 622 by means of couplers 64. The two end segments 622 extend downwardly from the curved intermediate segment 621, and have lower ends 6222 fitted removably and respectively into the coupling ends 6111 of the elbow connectors 611, such that the upper frame portion 62 and the lower base portion 61 cooperate to form a ball projectile opening 66.

The upright rear leg rod 5 has an upper end 51 and a lower end 52. The upper end 51 is formed with a hook fastener 511 for engaging removably the curved intermediate segment 621 of the upper frame portion 62 of the barrier frame 6. The lower end 52 is reduced in diameter to form a lower shoulder 512, and is adapted to be buried in the ground surface. The lower end 52 cooperates with the elbow connectors 611 to form three supporting points that are to be disposed in a triangular formation on the ground surface.

The support rod unit 8 includes a pair of support rods 81, each of which has a first end 811 sleeved on the lower end 52 of the rear leg rod 5 and a second end 812 sleeved on a respective one of the elbow connectors 611 of the lower base portion 61.

The barrier fabric net 7 has a peripheral portion 71 connected to the barrier frame 6, is loosely draped on the barrier frame 6 so as to form a lower section 73 that extends to the ground surface, and is adapted to collect a ball that passes through the barrier frame 6 and that impinges upon the net 7, as best illustrated in FIG. 7. The peripheral portion 71 is provided with a plurality of fasteners 713 spacedly disposed there along for engaging removably the lower base portion 61 and the upper frame portion 62 of the barrier frame 6. In this embodiment, each of the fasteners is a hook-and-loop strap fastener 711, 712. The lower section 73 is provided with an upright fence 72 that is disposed adjacent to the lower base portion 61 of the barrier frame 6 and that prevents the ball (not shown) collected in the net 7 from rolling out of the net 7 via the barrier frame 6.

To assemble for use, the pole segments 621, 622 of the upper frame portion 62 are connected first. The rear leg rod 5 is then hooked on the upper frame portion 62. The second ends 812 of the support rods 81 are sleeved respectively on the coupling ends of the elbow connectors 611, and the upper frame portion 62 is brought to connect with the lower base portion 61 so as to form the barrier frame 6. The lower end 52 of the rear leg rod 5 is then extended through the first ends 811 of the support rods 81 and into the ground surface. The barrier frame 6 is stably supported on the ground surface at this time. Finally, the net 7 is loosely draped on the barrier frame 6. To disassemble the ball barrier assembly 4, the assembling process is performed in a reverse order, and the parts are disconnected one after the other. The disconnected parts are subsequently tied together to facilitate storage.

Figure 8:
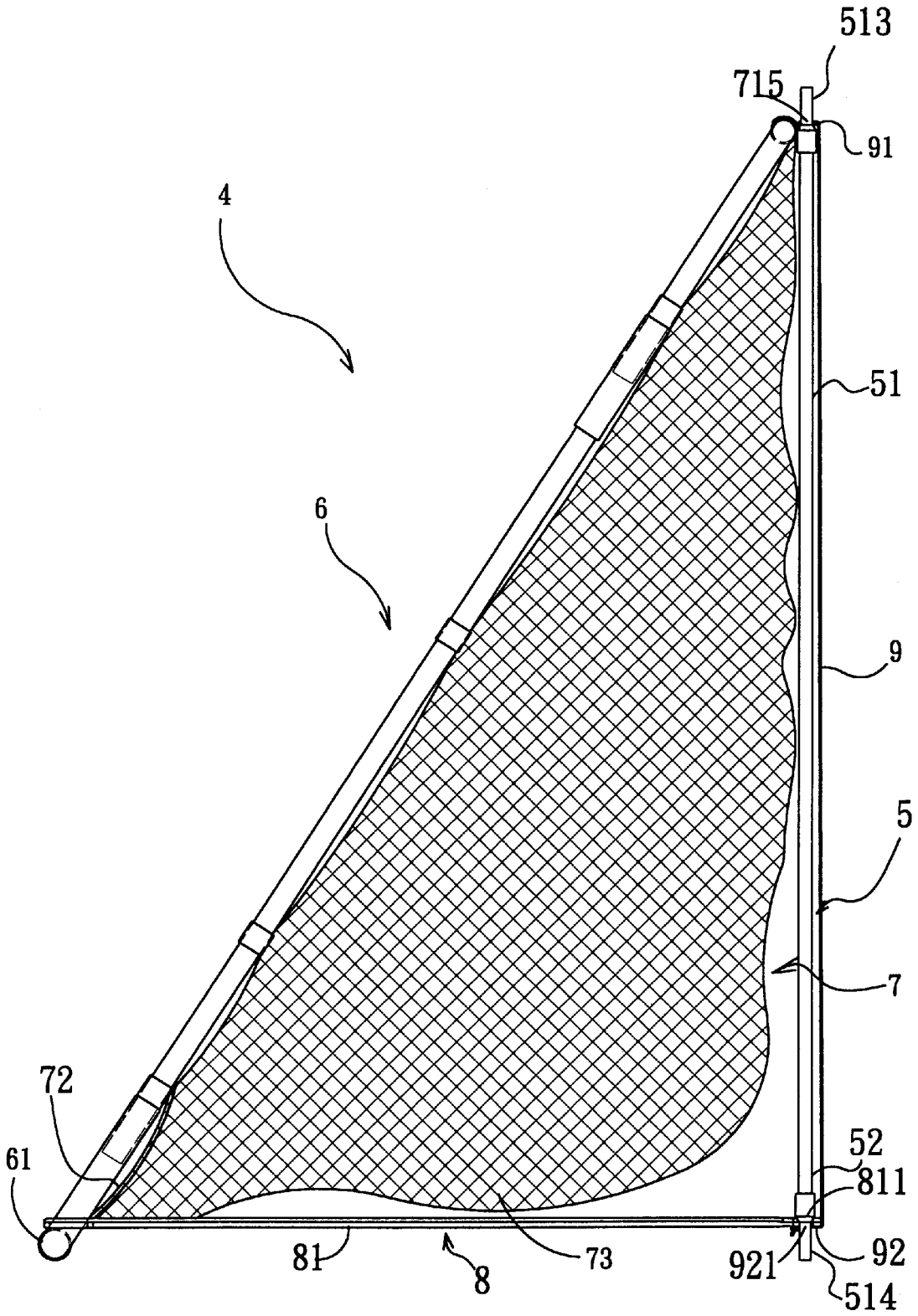
FIG. 8 is a schematic side view of the second preferred embodiment of a ball barrier assembly according to the present invention.

Referring to FIG. 8, the second preferred embodiment of the ball barrier assembly 4 according to the present invention is shown to be substantially similar to the first preferred embodiment. However, in this embodiment, each of the upper and lower ends 51, 52 of the rear leg rod 5 is reduced in diameter to form the rear leg rod 5 with upper and lower shoulders 513, 514. The peripheral portion of the net 7 is formed with an upper slip ring 715 that is sleeved on the upper end 51 of the rear leg rod 5. The ball barrier assembly 4 further comprises an elastic strap 9 having an upper end 91 and a lower end 92. The upper end 91 is connected to the peripheral portion of the net 7. The lower end 92 is formed with a lower slip ring 921 that is sleeved on the lower end 52 of the rear leg rod 5, thereby pulling the upper slip ring 715 to abut against the upper shoulder 513 of the rear leg rod 5, and thereby pulling the lower slip ring 921 to push the first ends 811 of the support rods 81 against the lower shoulder 514 of the rear leg rod 5. As such, the barrier frame 6 can be supported more firmly on the ground surface.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A ball barrier assembly comprising:

a looped barrier frame having a lower base portion adapted to be disposed on a ground surface and formed with at least two linear segments, and an upper frame portion with a curved intermediate segment and two end segments that extend downwardly from said curved intermediate segment and that are connected to said lower base portion, said lower base portion of said barrier frame including a horizontal rod and a pair of elbow connectors that are respectively disposed on opposite ends of said horizontal rod and said upper frame portion of said barrier frame being formed as a flexible pole;

an upright rear leg rod having an upper end connected to said curved intermediate segment of said upper frame portion of said barrier frame, and a lower end adapted to be disposed on the ground surface so as to cooperate with said at least two linear segments of said lower base portion of said barrier frame to form at least three supporting points that are to be disposed in a triangular formation on the ground surface, each of said upper and lower ends of said rear leg rod being reduced in diameter to form said rear leg rod with upper and lower shoulders;

a support rod unit interconnecting said lower end of said rear leg rod and said lower base portion of said barrier frame, said support rod unit including a pair of support rods, each of which has a first end connected to said lower end of said rear leg rod and a second end connected to a respective one of said elbow connectors, said first and second ends of said support rods being sleeved on the respective one of said lower end of said rear leg rod and said elbow connectors; and a barrier fabric net having a peripheral portion connected to said barrier frame, said net being loosely draped on said barrier frame so as to form a lower section that extends to the ground surface and that is adapted to collect a ball that passes through said barrier frame and that impinges upon said net and said peripheral portion of said net being formed with an upper slip ring that is sleeved on said upper end of said rear leg rod.

2. The ball barrier assembly of claim 1, further comprising an elastic strap having an upper end connected to said peripheral portion of said net, and a lower end formed with a lower slip ring that is sleeved on said lower end of said rear leg rod, thereby pulling said upper slip ring to abut against said upper shoulder, and thereby pulling said lower slip ring to push said first ends of said support rods against said lower shoulder.

* * * * *